US006715962B2

(12) United States Patent
Roberts et al.

(10) Patent No.: US 6,715,962 B2
(45) **Date of Patent: *Apr. 6, 2004**

(54) ASSEMBLY AND FLOATATION METHOD FOR DRILLING DRIVEPIPE

(75) Inventors: Billy J. Roberts, deceased, late of Houston, TX (US), by Jenova J. Roberts, executrix; William H. Strong, Richmond, TX (US)

(73) Assignee: Smith International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/754,474

(22) Filed: Jan. 4, 2001

(65) Prior Publication Data

US 2001/0030045 A1 Oct. 18, 2001

Related U.S. Application Data

(60) Provisional application No. 60/174,861, filed on Jan. 7, 2000.

(51) Int. Cl.[7] ..... F16L 1/12; E21B 33/037

(52) U.S. Cl. ..... 405/158; 405/154.1; 405/169; 405/171; 166/338; 175/5

(58) Field of Search ..... 405/154.1, 158, 405/166–171, 184.5, 203, 204, 205, 224.2–224.4, 227, 228, 63–66; 166/338, 350, 351, 359, 367; 175/5–10; 114/244, 245; 441/133

(56) References Cited

U.S. PATENT DOCUMENTS

| | | | | | |
|---|---|---|---|---|---|
| 2,731,800 | A | * | 1/1956 | Collins | 405/171 X |
| 3,566,609 | A | * | 3/1971 | Smith | 405/167 |
| 3,668,878 | A | * | 6/1972 | Jones et al. | 405/167 |
| 3,932,999 | A | | 1/1976 | Todd | 61/53.5 |
| 4,000,624 | A | * | 1/1977 | Chow | 405/204 |
| 4,015,435 | A | * | 4/1977 | Shaw | 405/166 |
| 4,040,264 | A | | 8/1977 | Neilon | 61/86 |
| 4,048,686 | A | | 9/1977 | Ege | 9/8 |
| 4,107,933 | A | * | 8/1978 | Lamy | 405/171 |
| 4,117,693 | A | | 10/1978 | Fournie | 405/171 |
| 4,121,529 | A | | 10/1978 | Smith et al. | 114/331 |
| 4,191,494 | A | | 3/1980 | Nakamura et al. | 405/171 |
| 4,281,614 | A | * | 8/1981 | McNary et al. | 114/264 |
| 4,377,354 | A | * | 3/1983 | Morton | 405/171 |
| 4,545,444 | A | | 10/1985 | Webb et al. | 175/296 |
| 4,712,946 | A | * | 12/1987 | Greatorex et al. | 405/170 |
| 4,789,269 | A | * | 12/1988 | Ayers et al. | 405/158 |

(List continued on next page.)

FOREIGN PATENT DOCUMENTS

| | | | | |
|---|---|---|---|---|
| EP | 0 525 865 A1 | | 2/1993 | E02D/7/08 |
| GB | 2182375 | * | 5/1987 | 405/195.1 |
| GB | 2 206 628 A | | 5/1988 | E02B/17/02 |

OTHER PUBLICATIONS

GB0100338.3, Mar. 13, 2001, UK Search Report.

*Primary Examiner*—Jong-Suk (James) Lee

(57) ABSTRACT

A method for assembling and delivering a drivepipe to a drill site. The method has the following steps: The drivepipe is assembled at a shoreline assembly station. Floatation devices are attached to the drivepipe and the drivepipe is floated in the ocean. The drivepipe is towed with tow vessels to a drill site. The drivepipe is delivered in a horizontal orientation to a drilling vessel at the drill site. An upper end of the drivepipe is attached to the drilling vessel and the tow vessels are detached from the drivepipe. The drivepipe is pivoted about its point of attachment to the drilling vessel until the drivepipe is vertically oriented. The buoyancy function of the floatation devices attached to the drivepipe is deactivated. The floatation devices are removed from the drivepipe. The drivepipe is equipped with a driving mechanism and the drivepipe is lowered with a running string from the drilling vessel to the sea bed.

13 Claims, 13 Drawing Sheets

U.S. PATENT DOCUMENTS 4,798,500 A * 1/1989 Morton ..... 405/158
4,810,133 A * 3/1989 Kopp et al. ..... 405/171 X
4,858,690 A * 8/1989 Rebardi et al. ..... 166/278
5,082,069 A 1/1992 Seiler et al. ..... 175/5
5,174,393 A 12/1992 Roberts et al. ..... 175/297
5,184,686 A 2/1993 Gonzalez ..... 175/5
5,308,194 A * 5/1994 Carruba ..... 405/227 X
5,449,253 A 9/1995 Roger ..... 405/245
5,503,228 A 4/1996 Anderson ..... 166/301
5,595,244 A * 1/1997 Roberts ..... 166/178
5,660,234 A 8/1997 Hebert et al. ..... 166/368
5,683,204 A * 11/1997 Lawther ..... 405/171
6,102,119 A 8/2000 Raines ..... 166/244.1
6,250,395 B1 * 6/2001 Torres ..... 166/382

* cited by examiner

ASSEMBLY AND FLOATATION METHOD FOR DRILLING DRIVEPIPE

REFERENCE STATEMENT

This application claims the benefit of U.S. Provisional Application No. 60/174,861, filed Jan. 7, 2000.

TECHNICAL FIELD OF THE INVENTION

The present invention relates generally to deep water offshore drilling utilizing floating rigs, and more particularly, to a method for assembling, transporting and installing a drilling assembly, including a drivepipe.

BACKGROUND OF THE INVENTION

In deep water drilling operations, shallow water flow (SWF) hazards have become increasingly troublesome. SWF derives its name from the phenomena of a flow, emanating from a subsurface and overpressurized zone, back to the seafloor. An overpressurized subsurface zone is formed naturally when an impermeable seal is formed over sandy settlements by rapid deposition of silty material. As the silty material is deposited over the sealed, sandy aquifer, the trapped water in the sandy settlement is unable to escape. Over time, the pressure increases in the sandy aquifer until the pressure developed is equal to or greater than the hydrostatic pressure at the depth of water at the location of the sandy aquifer. A shallow water flow occurs when the impermeable seal of silty material is penetrated to release the overpressure within the sandy aquifer. In some cases, the pressures are high enough to cause powerful flows of water and sand into the well bore. Waterflows destabilize the wellbore through erosion to collapse and in some cases damage the well bore and others adjacent thereto. Shallow waterflow hazards have been encountered in many areas of the world and continue to be a problem in deepwater drilling operations.

One solution for avoiding shallow waterflow hazards is to use a drivepipe. The drivepipe is driven into the formation past the high pressure sandy aquifer. The drivepipe becomes the casing for the well bore through which subsequent drilling operations may be conducted. Since the drivepipe is driven into the formation, the soil is compressed and compacted in the immediate vicinity of the drivepipe. Compacted soil seals the drivepipe in the formation to prevent shallow water flow around the drivepipe.

Drivepipes are usually 30 to 36 inches in diameter, having a wall one inch thick, although in some instances, the drivepipe can be 42 inches, or larger, in diameter, with a two inch wall thickness. Drivepipes are typically 350 to 450 feet in length for shallow water drilling operations if driven from the surface. In drilling operations, it has been found that a drivepipe can not penetrate beyond a certain amount, usually around the 450 feet length, because at that length, the resistance caused by skin friction becomes greater than the force of gravity and the force applied from the surface by conventional hammer means. The drivepipe will reach a point of refusal and any further force applied to the uppermost section of the drivepipe will cause yielding of the pipe material and any further driving efforts must be discontinued.

In deep water drilling operations, drivepipes having lengths of 1000 feet or more are sometimes required to mitigate shallow water flow hazards. Therefore, auxiliary means for driving drivepipes are necessary to augment the gravitational forces acting on the drivepipes to increase the depth of penetration of the drivepipes. Presently, drivepipes of this length are driven into the seafloor only by the force of gravity. At greater water depths, the application of force to the tops of the drivepipes is impractical due to the wasted energy absorption by the longer lengths. Although proven that any force applied is more effective if applied at the bottoms of the drivepipes, few methods exist for this application and are limited by the long umbilical required to supply electrical or hydraulic forces to the hammers. Some drivepipes are equipped with a drilling assembly and/or a drive assembly. The drill string continues below the running tool and extends down the entire length of the interior of the drivepipe. The lower end of the drill string assembly terminates with a jet sub or downhole motor connected to a stabilized drill bit. In alternative drivepipes, a drill bit is located at the mouth or lower opening of the drivepipe, and is driven by the motor to function as a jetting assembly to drill a hole approximately the size of the inner diameter of the drivepipe.

In an offshore deep water drilling installation, a drivepipe is typically installed by assembling the drivepipe one section at a time as the sections are hung from a floating drilling vessel. Drivepipes are assembled from various sections of pipe and fitted with the necessary driving mechanisms on the floating drilling vessel at the production site. Lengthy drivepipes having complicated driving mechanism require a good deal of time to assemble on the floating drilling vessel. Since the cost of a drilling project is directly connected to the amount of time that a floating drilling vessel must be dedicated to the particular drilling project, cost reductions may be obtained by accelerating the drilling process. The time required to assemble a drivepipe and fit the drivepipe with the necessary driving mechanisms has been identified as a significant portion of the overall project duration parameter. Therefore, there is a need for a method for assembling the drivepipe and fitting the drivepipe with the necessary driving mechanisms in such a way that the time required for the floating drilling vessel to be at the drilling site is reduced.

SUMMARY OF THE INVENTION

The present invention is a method and apparatus which reduces the time required for a floating drilling vessel to be at the production site because the vessel is not required during drivepipe assembly. In particular, the present invention is a process for assembling a drivepipe in its entirety at a shoreline assembly station and transporting the assembled drivepipe to the drilling vessel. Once delivered, the drivepipe is made up to a running string and lowered to the seabed. This invention obviates the requirement that the floating drilling vessel be used during the assembly process.

According to one aspect of the invention, there is provided a method for assembling and delivering a drivepipe to a drill site, the method comprising: assembling the drivepipe at a shoreline assembly station; attaching floatation devices to the drivepipe and floating the drivepipe in the ocean; towing the drivepipe with tow vessels to a drill site; delivering the drivepipe in a horizontal orientation to a drilling vessel at the drill site; attaching a upper end of the drivepipe to the drilling vessel and detaching the tow vessels from the drivepipe; pivoting the drivepipe about its point of attachment to the drilling vessel until the drivepipe is vertically oriented; deactivating the buoyancy function of the floatation devices attached to the drivepipe; removing the floatation devices from the drivepipe; equipping the drivepipe with a driving mechanism; and lowering the drivepipe with a running string from the drilling vessel to the sea bed.

According to a further aspect of the invention, there is provided a process for assembling a drive pipe for use at an offshore drill site, the process comprising: assembling the drive pipe at a shoreline assembly station; floating the drive pipe in the ocean; transporting the floating drive pipe from the shoreline assembly station to the offshore drill site; suspending the floating drive pipe from a drilling vessel at the offshore drill site; and deploying the drive pipe to the ocean floor.

According to still another aspect of the invention, there is provided a process for assembling a drive pipe for use at an offshore drill site, the process comprising: assembling the drive pipe at a shoreline assembly station, wherein the assembling comprises fitting pipe sections end to end; floating the drive pipe in the ocean; transporting the floating drive pipe from the shoreline assembly station to the offshore drill site, wherein the transporting comprises towing the drive pipe through the ocean, wherein the drive pipe is submerged in the ocean in an approximately neutrally buoyant condition during the towing; suspending the floating drive pipe from a drilling vessel at the offshore drill site, wherein the suspending comprises coupling an upper end of the drive pipe to the drilling vessel and sinking the drive pipe in the ocean, whereby a substantial portion of the weight of the drive pipe is supported by the drilling vessel; deploying the drive pipe to the ocean floor, wherein the deploying comprises attaching the upper end of the drive pipe to a drill string and lowering the drive pipe to the ocean floor with the drill string.

According to another aspect of the invention, there is provided a process for reducing the amount of time required for a drill vessel to assemble and deploy a drive pipe at an offshore drill site, the process comprising: delivering an assembled drive pipe to the drill vessel at the offshore drill site; suspending the drive pipe from the drilling vessel; and deploying the drive pipe to the ocean floor.

BRIEF DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

It is to be noted, however, that the appended drawings illustrate only typical embodiments of this invention and are therefore not to be considered limiting of its scope, as the invention may admit to other equally effective embodiments.

DETAIL DESCRIPTION OF THE INVENTION

One aspect of the invention is to assemble the drivepipe in its entirety at a shoreline assembly station. Such assembly may be done either parallel or perpendicular to the shoreline. Once assembled, the drivepipe is fitted with floatation devices and set afloat in the ocean. Boats then tow the drivepipe to the drilling site where it is attached at its upper end to the drilling vessel. The floatation devices then allow the drivepipe to sink into the ocean until it becomes vertically oriented beneath the floating drilling vessel. Once the drivepipe is vertically oriented, the floatation devices are removed from the drivepipe. The drivepipe is then made up to a running string that is used to lower the drivepipe to the ocean floor from the floating drilling vessel.

Figure 1:
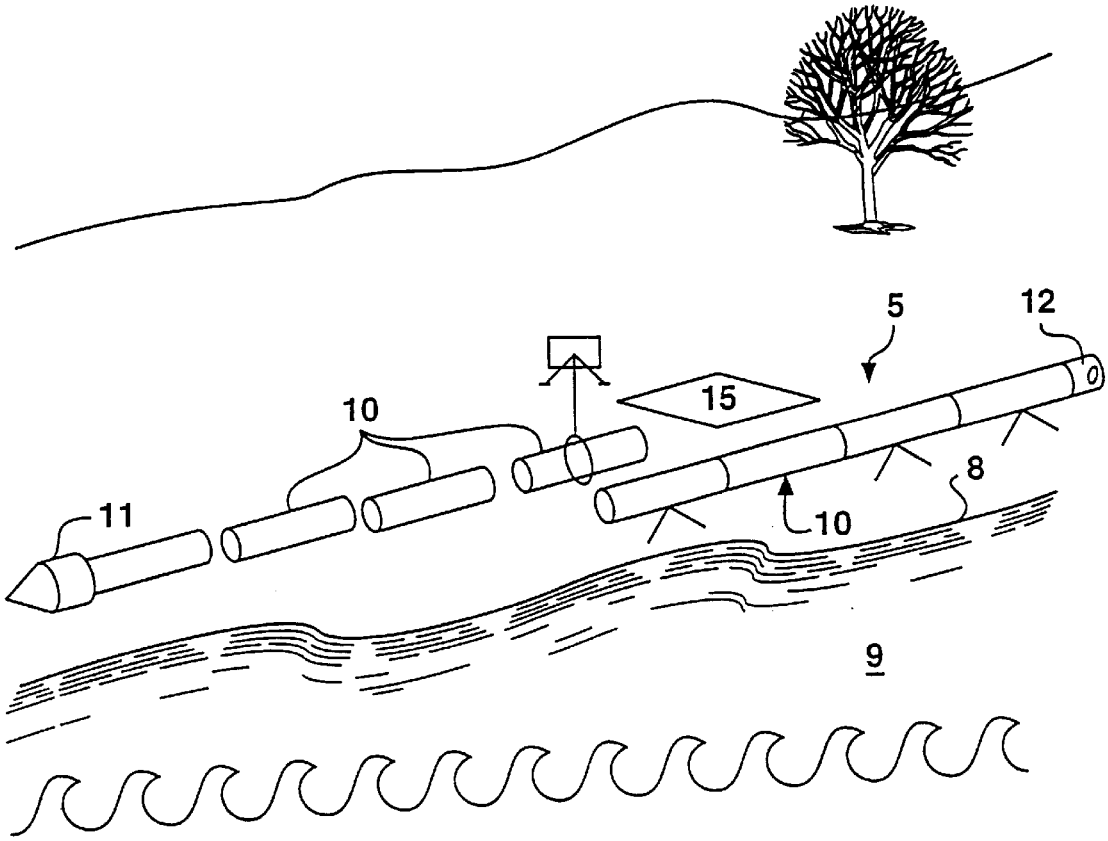
FIG. 1 is a perspective view of a drivepipe and being assembled at a shoreline assembly station.

Referring to FIG. 1, a perspective view of a drivepipe assembly station at a shoreline is shown adjacent the ocean. The drivepipe 5 is assembled by attaching pipe sections 10 end to end. The individual pipe sections 10 may be welded or pipe made-up with threaded connections at a make-up station 15 as is known in the art. A drive shoe 11 is attached to the leading end of the drivepipe 5 and a hinge coupling 12 is attached to the upper end of the drivepipe 5. Of course, heavy machinery and support devices are used to move and position the drivepipe 5 and pipe sections 10 as is known in the art during the assembly process.

Figure 2:
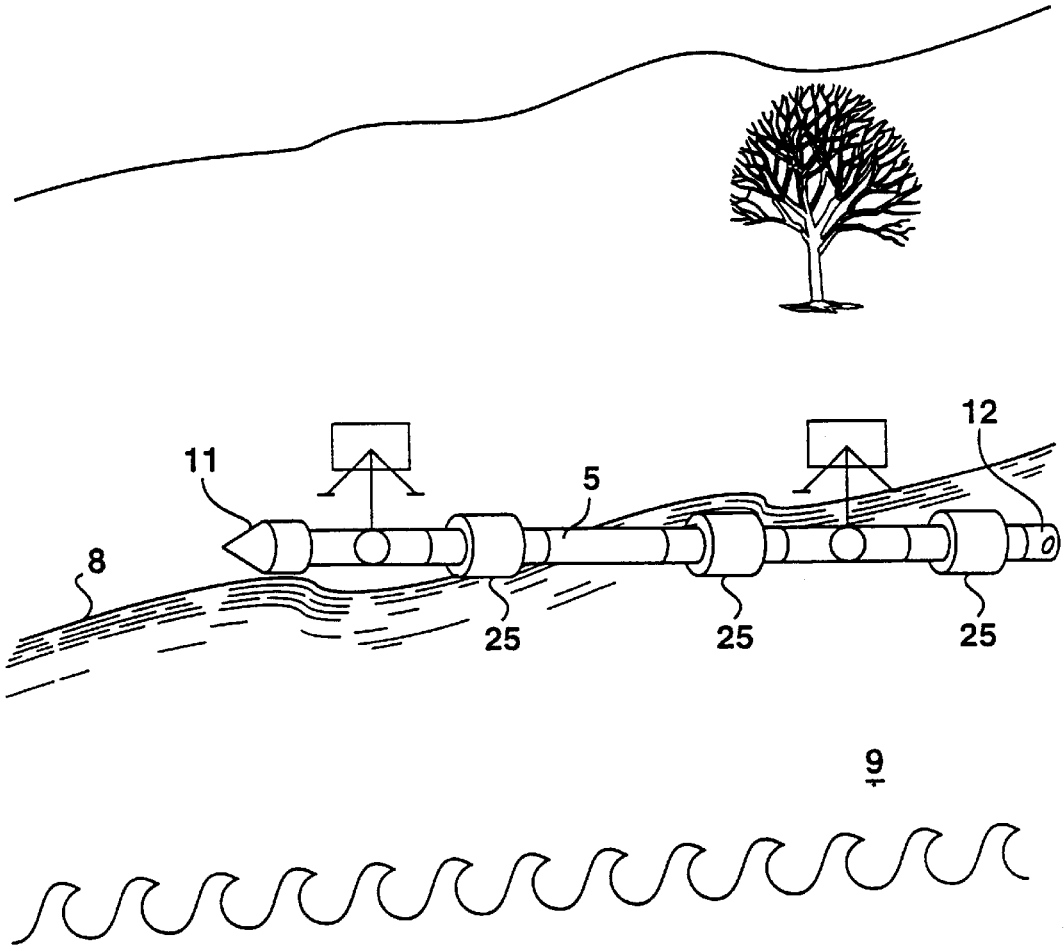
FIG. 2 is a perspective view of an assembled drivepipe being equipped with floatation devices at a shoreline assembly station.

As shown in FIG. 2, the assembled drivepipe 5 is fitted with floatation devices 25. In particular, floatation devices 25 are attached which are able to control the descent of the drivepipe in the ocean 9. Suitable buoyancy systems for the floatation devices 25 are disclosed in U.S. Pat. Nos. 4,121,529; 4,191,494; 4,117,693; 4,048,686; and 4,040,264, all incorporated herein by reference. The floatation devices 25 are attached to the drivepipe 5 in sufficient number and at particular locations along the length of the drivepipe 5 so that extreme bending moments are not induced in the drivepipe 5 due to the force of gravity acting against the buoyant force of the floatation devices 25. Depending on the floatation devices 25 used with the system, the drivepipe 5 may be sealed with a watertight seal to create a gas filled chamber in its interior. In this embodiment, the gas filled chamber of the drivepipe 5 buoys the drivepipe 5 in the ocean 9 in addition to the buoyant forces imposed by the floatation devices 25. With the floatation devices 25 in place, the drivepipe 5 is floated into the ocean 9 adjacent the shoreline 8. Further, the floatation devices 25 are adjusted to impart a buoyant force to the drivepipe 5 until the drivepipe 5 is approximately neutrally buoyant and horizontally oriented in the water.

Figure 3:
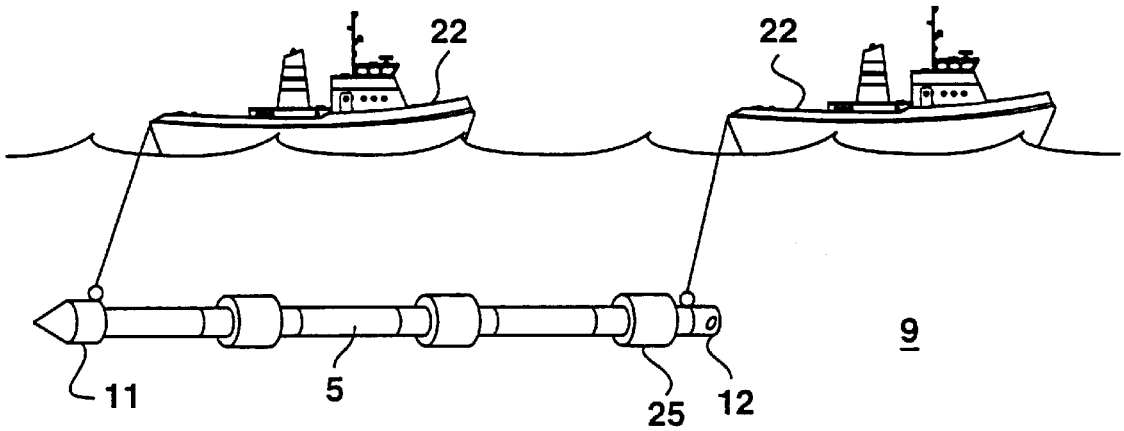
FIG. 3 is a perspective view of a drivepipe being towed from the shoreline assembly station to an offshore drilling site.

Referring to FIG. 3, a perspective view of the drivepipe 5 being transported from the shoreline assembly station to the production site is shown. The drivepipe 5 is shown at a neutrally buoyant position below the surface of the ocean 9. While the drivepipe may be towed on the surface of the ocean 9, in the embodiment of the invention shown, the drivepipe 5 is suspended at a neutrally buoyant position at a sufficient depth below the surface of the water to avoid wave action at the surface. It is preferable to tow the drivepipe 5 at a position below the wave action of the ocean so that the waves do not induce bending moments in the drivepipe 5 during transportation. At this depth, the drivepipe 5 is towed by any number of tow vessels 22 from the shoreline assembly station to an offshore drilling site. The tow vessels 22 are attached to the drivepipe 5 by towlines as is known in the art.

Figure 4:
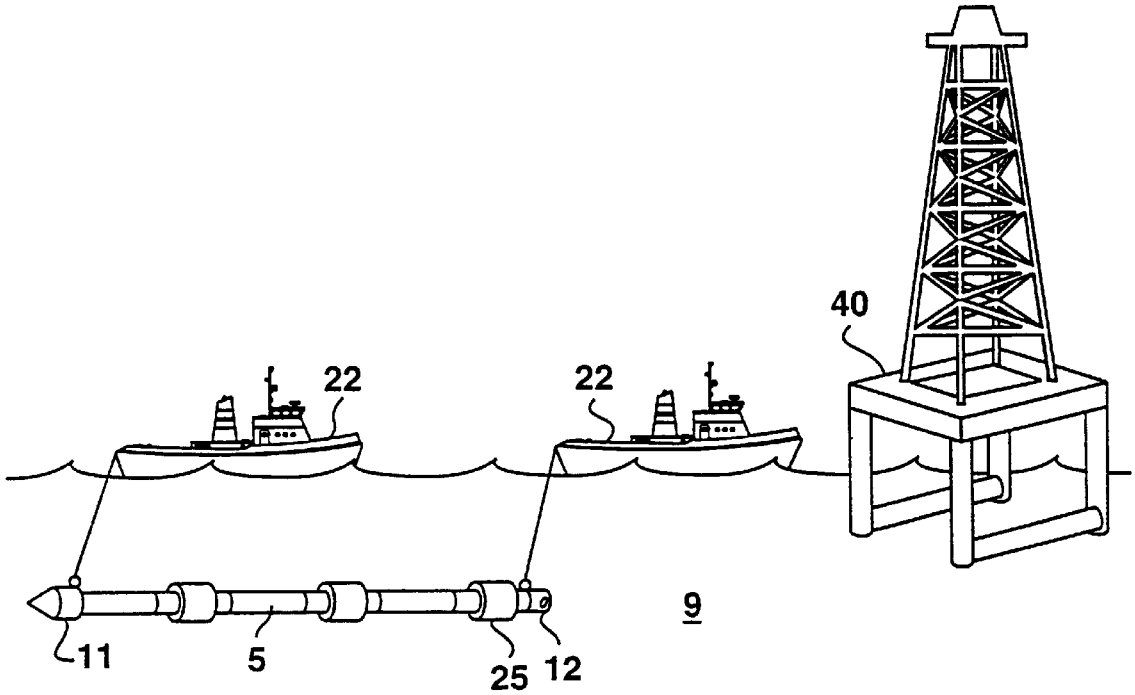
FIG. 4 is a perspective view of a drivepipe being delivered to an offshore semi-submersible platform.

Referring to FIG. 4, the assembled drivepipe 5 is delivered to the offshore drilling site. A drilling vessel 40 is properly positioned relative to the drilling site. In the embodiment shown in FIG. 4, the drilling vessel 40 is a semi-submersible platform. While a semi-submersible platform is shown, a drillship or any floating drilling vessel may be used with the present invention. The tow vessels 22 bring the upper end of the drivepipe 5 having the hinge coupling 12 into close proximity with the drilling vessel 40.

Figure 5:
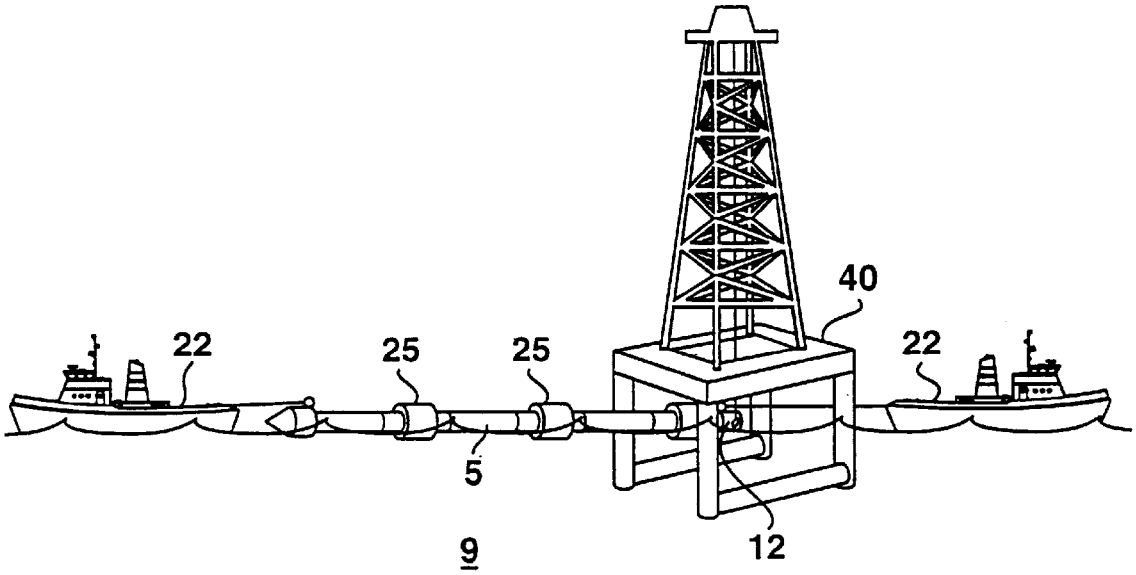
FIG. 5 is a perspective view of a drivepipe being positioned with its upper end immediately beneath an offshore semi-submersible platform wherein the upper end of the drivepipe is being secured to the platform.

As shown in Fig. 5, a perspective view of the drivepipe 5 being delivered to a drilling vessel 40 is shown. The upper end of the drivepipe 5 having the hinge coupling 12 is positioned beneath the drilling vessel 40 by the tow vessels 22. The floatation devices 25 then buoy the drivepipe 5 to the surface of the ocean 9 so that the hinge coupling 12 is accessible to the drilling vessel 40. Once properly positioned, the hinge coupling 12 of the drivepipe 5 is attached to the drilling vessel 40. Upon attachment of the hinge coupling 12 to the drilling vessel 40, the tow vessels 22 release the drivepipe 5. Attachment to the drivepipe may be made using wire rope, a clevis, the tubular drilling string from the drilling vessel, or any device known to those of skill.

Figure 6:
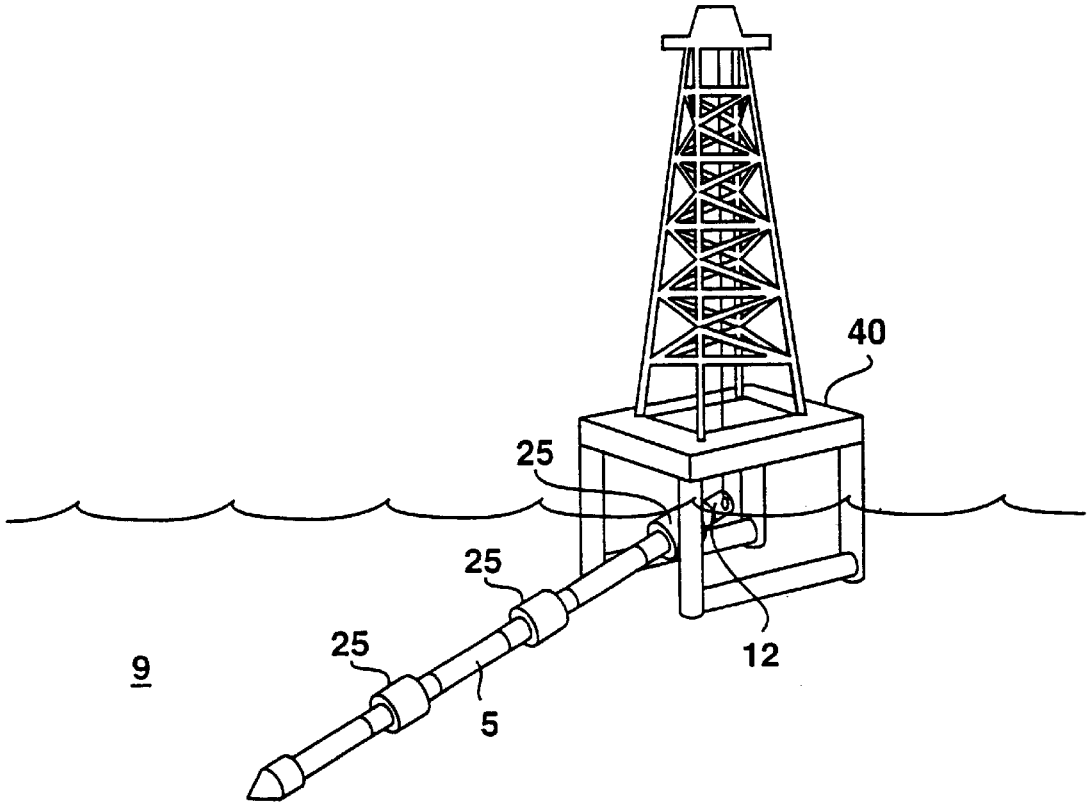
FIG. 6 is a perspective view of a drivepipe with its upper end attached to a semi-submersible platform and the remainder of the drivepipe being sunk into the ocean as the drivepipe pivots about its point of attachment to the platform.

Referring to FIG. 6, a perspective view of the drivepipe 5 and the drilling vessel 40 is shown. At this stage of the process, the tow vessels 22 are removed from the drilling site and the drivepipe 5 is freely floating with the hinge coupling 12 attached to the drilling vessel 40. The floatation devices 25, which are attached to the drivepipe 5, are then made to sink in the ocean 9. The floatation devices 25 farthest from the hinge coupling 12 are made to descend faster than floatation devices 25 closer to the hinge coupling 12. Throughout this process, the upper end of the drivepipe 5 remains attached or secured to the drilling vessel 40 by the hinge coupling 12. As the floatation devices 25 allow the drivepipe 5 to sink, the drivepipe 5 swings or rotates about its point of attachment to the floating drilling vessel 40 until the drivepipe is vertically oriented beneath the drilling vessel 40. Throughout the sinking process, the floatation devices 25 are regulated to maintain sufficient buoyant force on the drivepipe 5 to prevent bending moments from being generated in the drivepipe 5. This requires that each floatation device 25 be made to descend at a different rate depending on its point of attachment to the drivepipe 5. The floatation devices 25 provide a sufficient buoyant force so that the drivepipe 5 remains approximately neutrally buoyant as the drivepipe 5 is rotated from a horizontal orientation to a vertical orientation.

In embodiments of the invention where the drivepipe 5 is sealed with a water tight seal to create a gas filled chamber in its interior, it is preferable to maintain the integrity of the interior chamber until the drivepipe is vertically oriented. The allows the drivepipe 5 to remain neutrally buoyant as the drivepipe 5 is vertically oriented.

Figure 7:
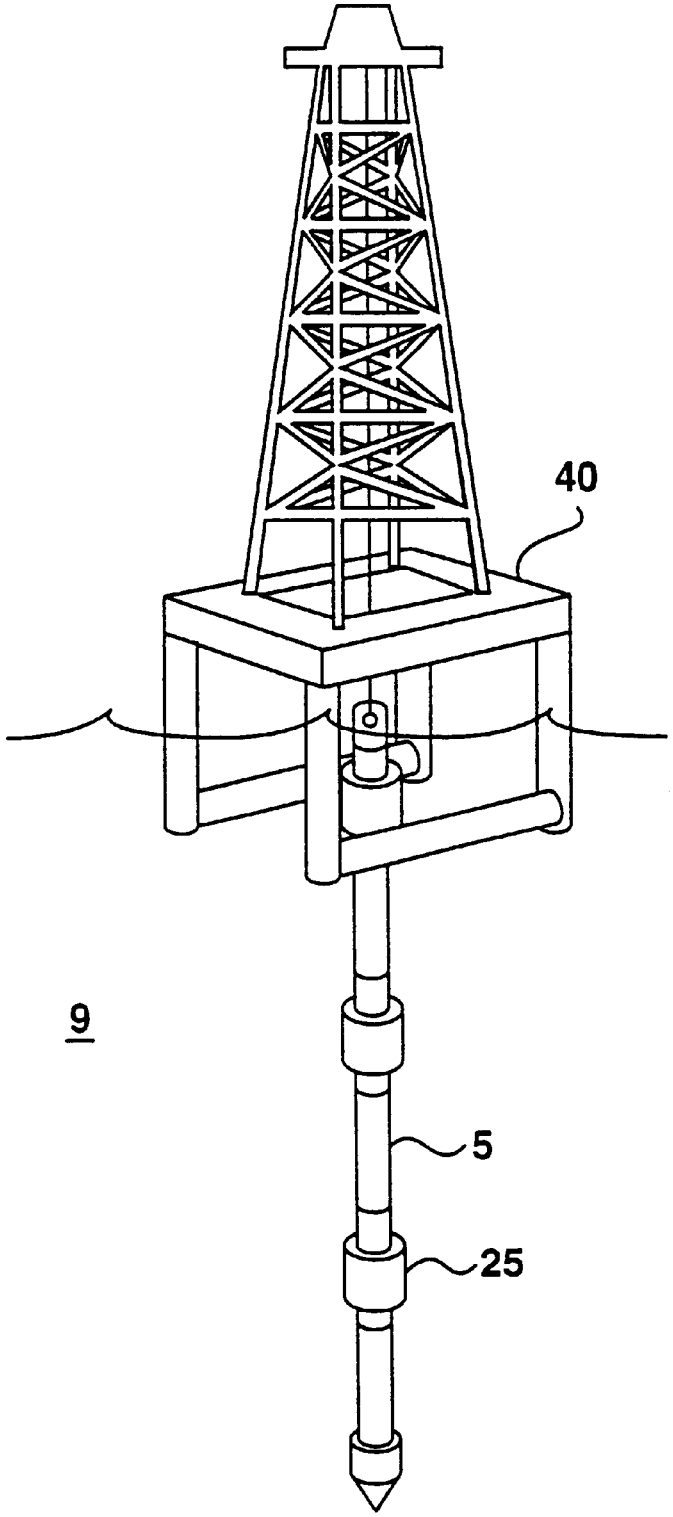
FIG. 7 is a perspective view of a drivepipe with its upper end attached to a semi-submersible platform and the entire drivepipe suspended vertically beneath the platform.

As shown in FIG. 7, the drivepipe 5 is vertically oriented under the drilling vessel 40. At this position, the floatation devices 25 continue to exert a buoyant force on the drivepipe 5 so that the weight of the drivepipe has not yet been transferred to the drilling vessel 40. However, the hinge coupling 12 remains attached to the drilling vessel 40.

Figure 8:
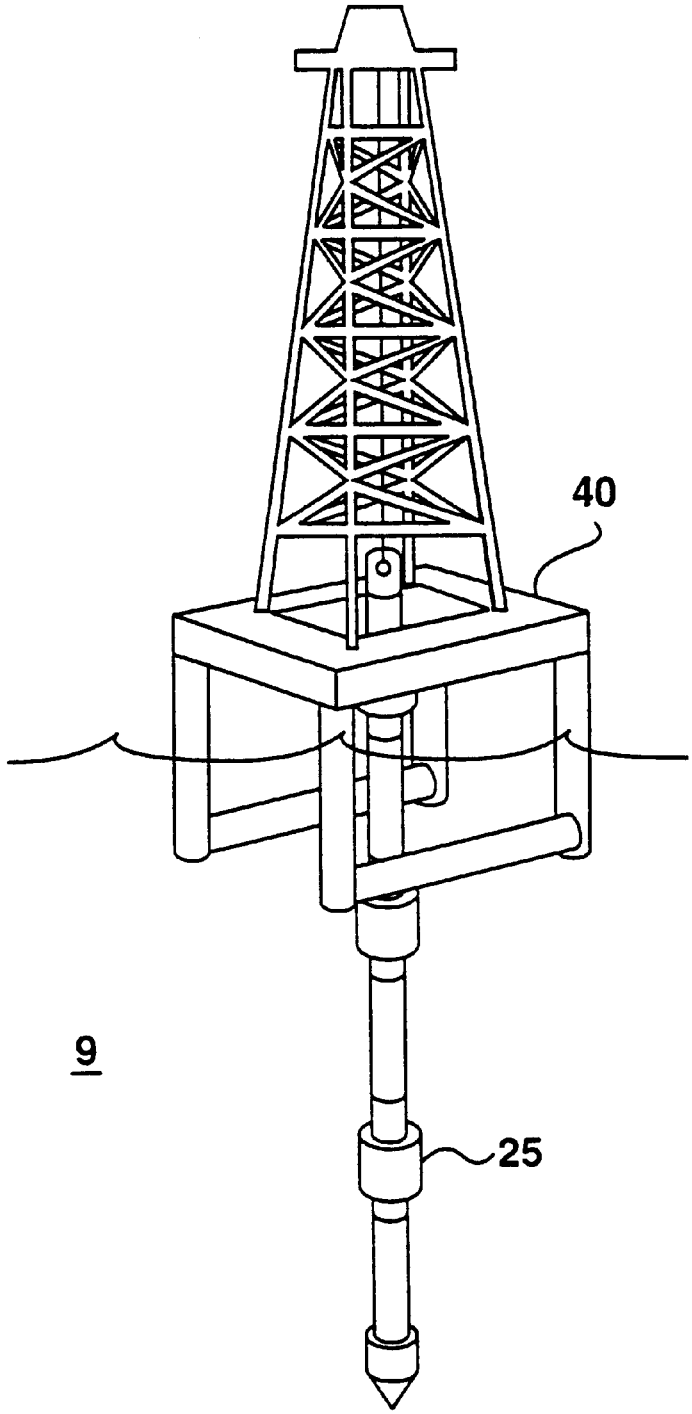
FIG. 8 is a perspective view of a drivepipe suspended beneath a platform with deactivated floatation devices still attached.

As shown in FIG. 8, the weight of the drivepipe 5 is transferred from the floatation devices 25 to the drilling vessel 40 by deactivating the buoyancy function of the floatation devices 25. In embodiments of the invention where the drivepipe 5 is sealed with a water tight seal to create a gas filled chamber in its interior, the buoyancy function of the interior chamber is breached by flooding the inside of the drivepipe 5 with sea water. Of course, as weight is transferred to the drilling vessel 40, the drilling vessel 40 is pulled deeper into the ocean 9.

Figure 9:
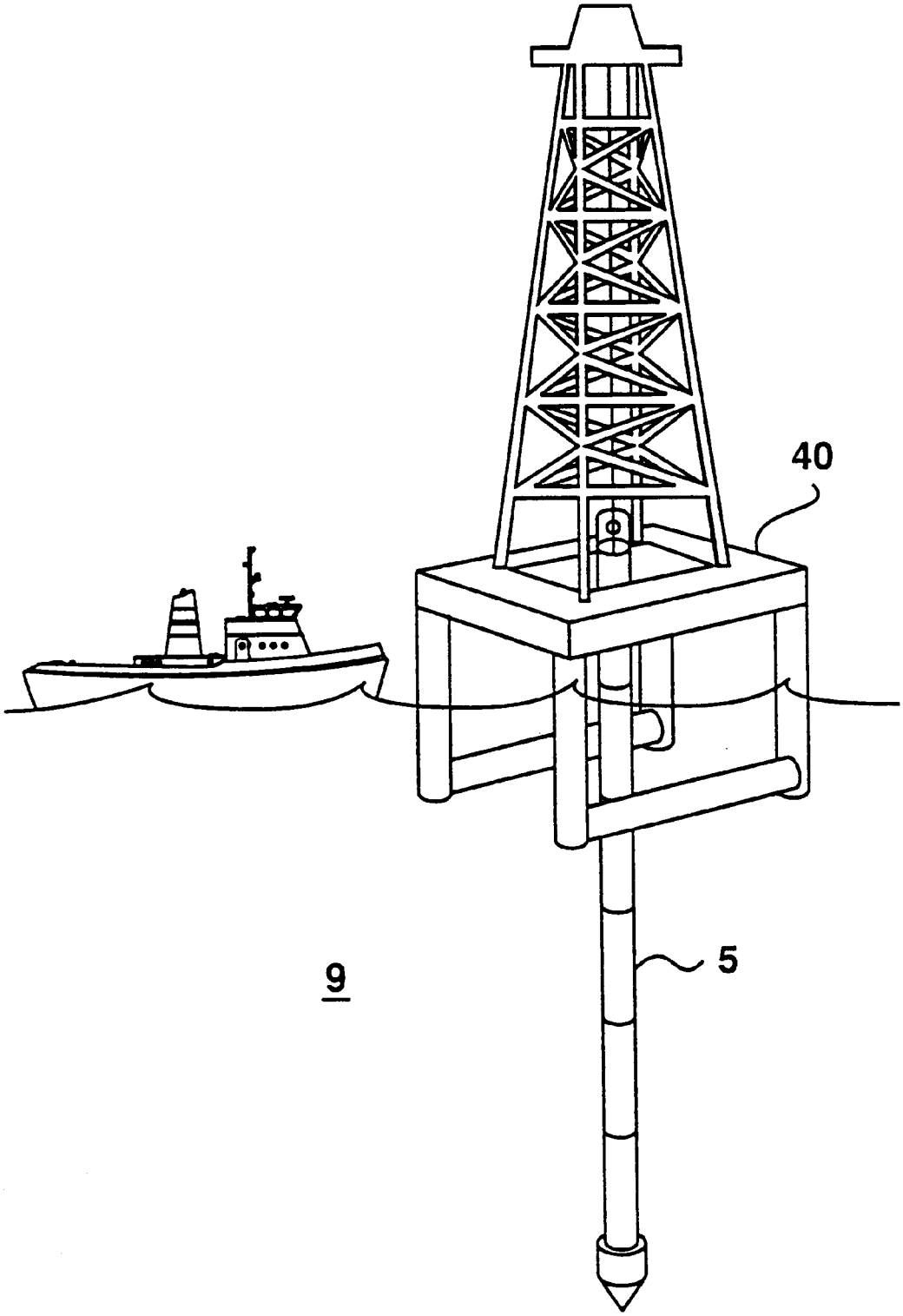
FIG. 9 is a perspective view of a drivepipe suspended beneath a floatation platform with floatation devices removed.

Referring to FIG. 9, a perspective view of the drilling vessel 40 and drivepipe 5 is shown, wherein the floatation devices 25 are removed from the drivepipe 5. The floatation devices 25 are removed from the drivepipe according to processes known to persons of skill in this art.

Figure 10:
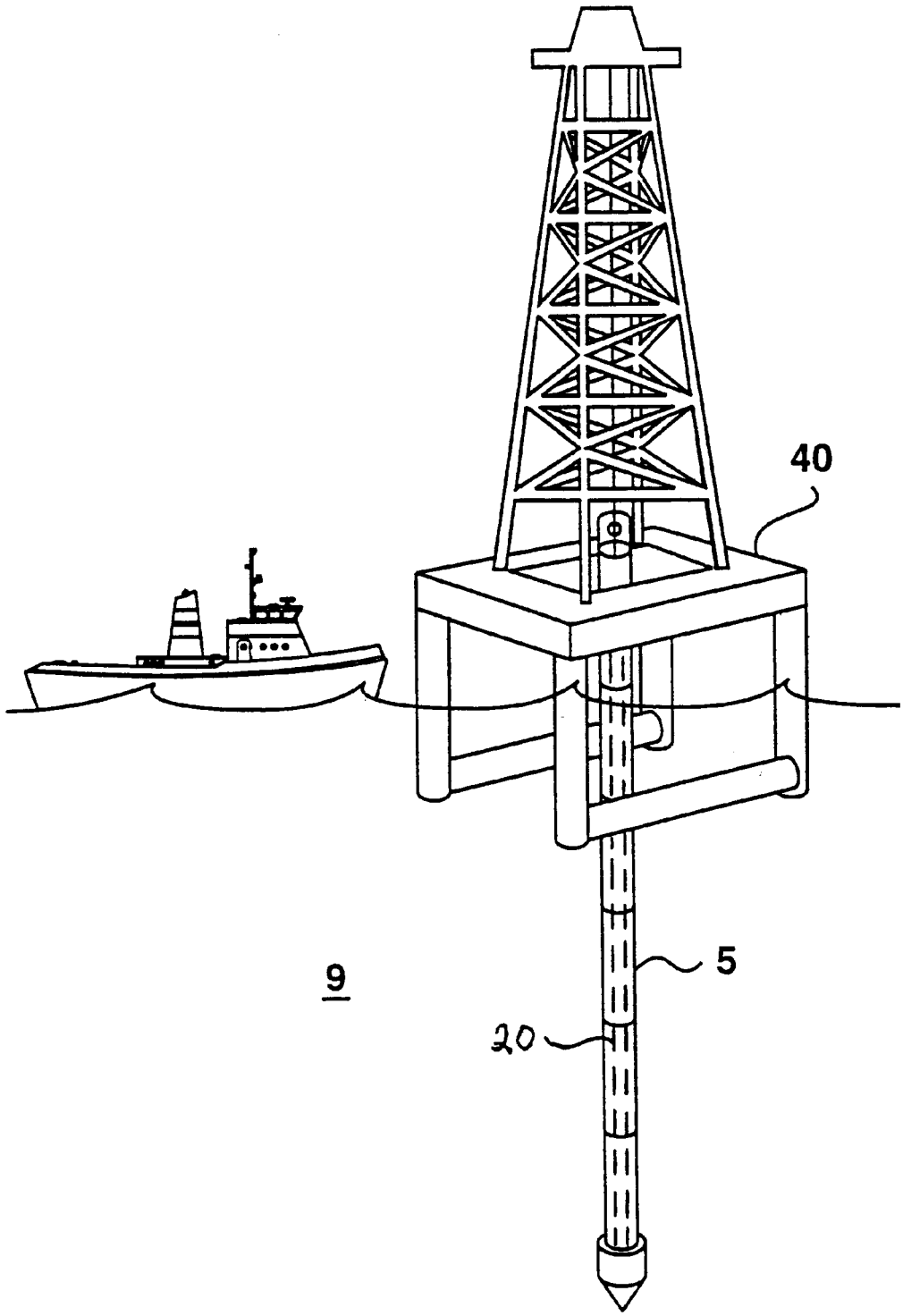
FIG. 10 is a perspective view of a drivepipe suspended beneath a floatation platform with a driving mechanism installed in the drivepipe for driving the drivepipe into the sea bed.

Referring to FIG. 10, a perspective view of the drilling vessel and drivepipe is shown, wherein the drivepipe has a driving mechanism installed therein. With the drivepipe 5 fully supported by the drilling vessel 40, a driving mechanism 20 is installed in the drivepipe 5 for driving the drivepipe 5 in to subterranean layers. Many different driving mechanisms 20 are possible depending on the particular drivepipe and drilling conditions anticipated.

In a first driving mechanism configuration, the driving mechanism 20 is a hydraulic hammer attached to the drivepipe between the driving shoe 11 and the hinge coupling 12. Conventional hydraulic hammers require an umbilical cord that extends from the hammer to the drilling vessel at the ocean surface.

Figure 12:
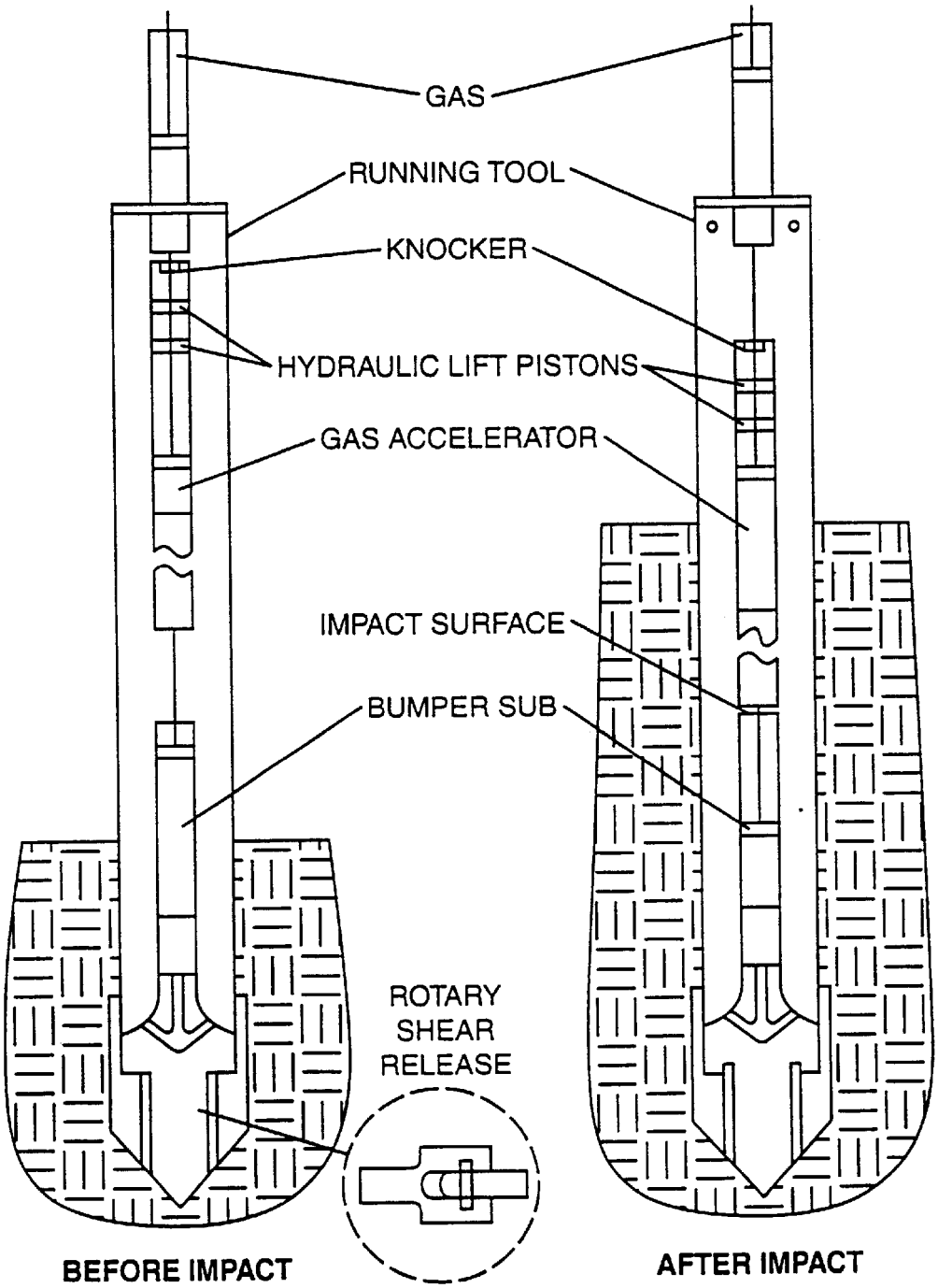
FIG. 12 is a side view of a drivepipe with a driving mechanism installed therein shown in before and after impact positions. The driving mechanism is configured to communicate momentum from the impact of the driving mechanism to the leading end of the drivepipe.

In a second configuration, the driving mechanism 20 is a drop weight system installed inside the drivepipe 5. For example, a drop weight system is shown in FIG. 12. Drop weight systems have lift pistons that lift a set of weights off an impact surface and allow the set of weights to fall again to the impact surface. The momentum generated by the weights is transferred to the drivepipe through the impact surface. Alternative embodiments of this second configuration are possible where the drop weight system is positioned within the drivepipe either at the leading end near the driving shoe or at a position closer to the middle of the drivepipe. In the embodiment shown in FIG. 12, the momentum of the impact is transferred to the leading end of the drivepipe.

Figure 13:
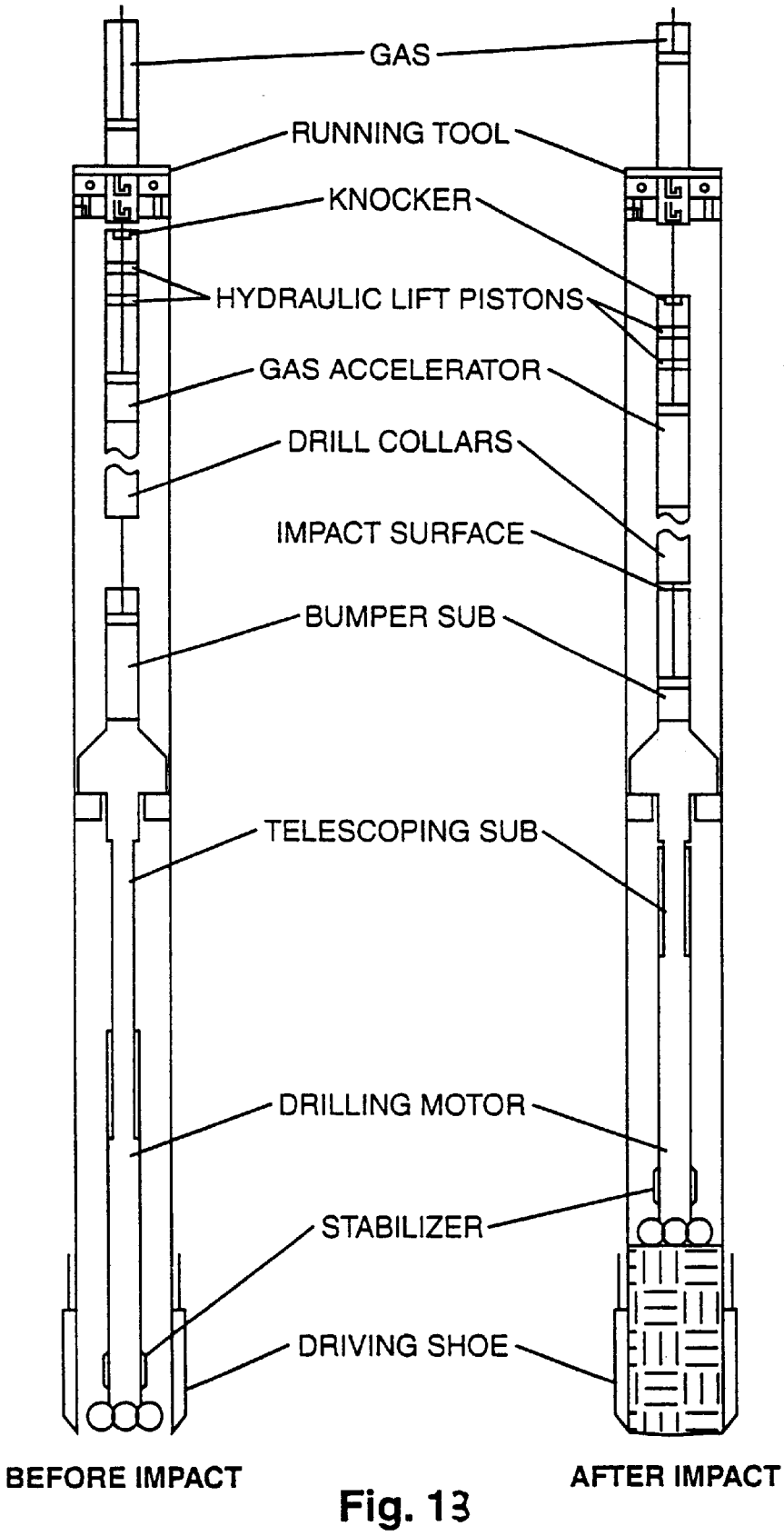
FIG. 13 is a side view of a drivepipe with a driving mechanism installed therein shown in before and after impact positions. The driving mechanism is configured to communicate momentum from the impact to the drivepipe at a point of the drivepipe about 40–60 feet from the bottom of the drivepipe. The driving mechanism is further configured with a drill motor and bit or other device below the impact device.

In a third configuration, a drop weight system is equipped with a drill that operates within an open face of the drive shoe 11. An example of this type of system is shown in FIG. 13. In this configuration, the drop weight system is attached within the drivepipe 5 at a midpoint location and the drill extends below the drop weight system. A mud motor below the drop weight system drives the drill bit.

Alternative driving mechanism configurations are also possible. Regardless of the configuration of the driving mechanism 20, to be used in the drivepipe 5, the driving mechanism 20 is installed in or attached to the drivepipe 5 while the drivepipe 5 is suspended from the drilling vessel 40. In this position, the driving mechanism 20 (shown in FIGS. 10, 12 and 13) for driving the drivepipe 5 into the seabed is made ready and tested.

Figure 11:
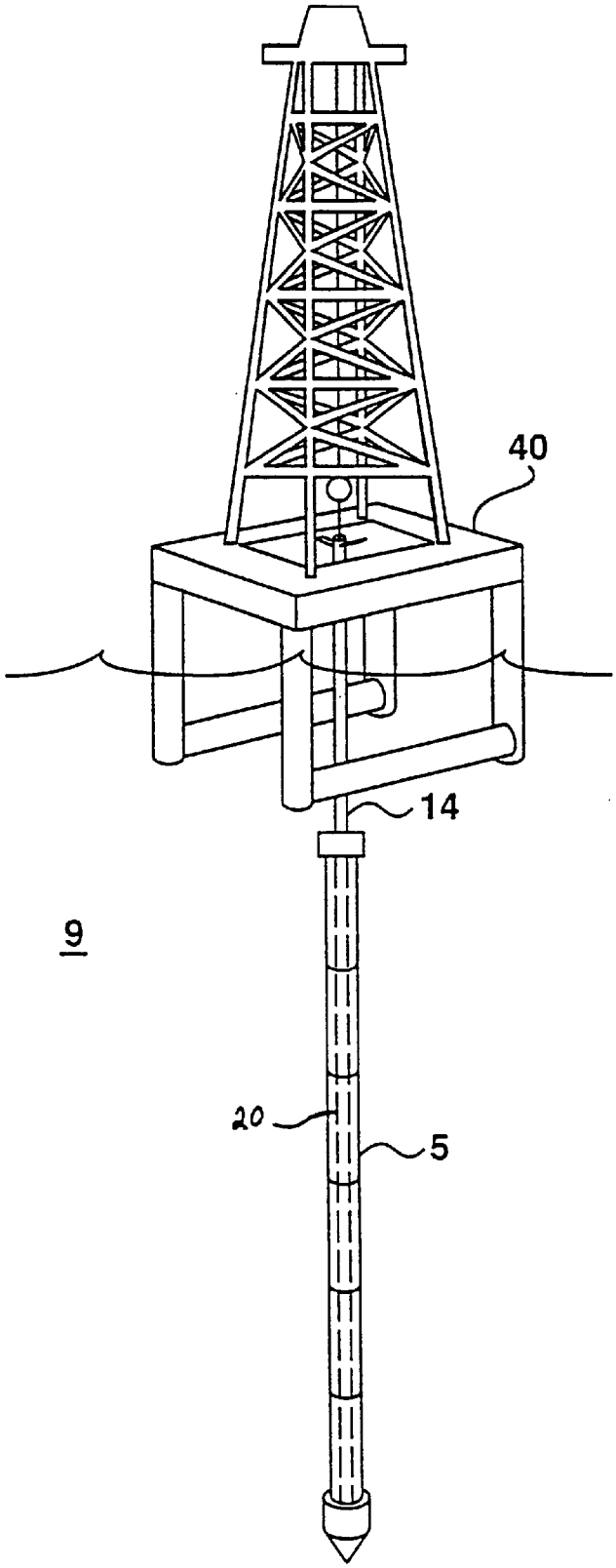
FIG. 11 is a perspective view of a drivepipe suspended from a platform by a running string made up to the drivepipe.

Referring to FIG. 11, a perspective view of the drivepipe 5 suspended by a running string 14 is shown. After the drivepipe 5 is equipped with a driving mechanism, the drivepipe 5 is then lowered from the drilling vessel 40 to the sea bed. In the embodiment shown, a running string 14 is made up to the upper end of the drivepipe 5 for suspending the drivepipe 5 from the drilling vessel 40. The hinge coupling 12 is removed from the drivepipe 5 and the running string 14 is made-up directly to the drivepipe 5. Additional sections of the running string 14 are made up as the drivepipe 5 is lowered from the drilling vessel 40 to the sea floor.

While the particular embodiments for drilling drivepipe assembly and floatation methods as herein shown and disclosed in detail are fully capable of obtaining the objects and advantages hereinbefore stated, it is to be understood that they are merely illustrative of the preferred embodiments of the invention and that no limitations are intended by the details of construction or design herein shown other than as described in appended claims.

What is claimed is:

1. A process for assembling a drive pipe for use at an offshore drill site, said process comprising:

assembling the drive pipe at a shoreline assembly station;

floating the drive pipe in the ocean;

transporting the floating drive pipe from the shoreline assembly station to the offshore drill site;

suspending the floating drive pipe from a drilling vessel at the offshore drill site;

deploying the drive pipe to the ocean floor;

wherein said floating comprises sealing an interior cavity of said drive pipe, whereby a gas filled chamber is created within said drive pipe which buoys the drive pipe.

2. The process for assembling a drive pipe as claimed in claim 1, wherein said assembling comprises fitting pipe sections end to end.

3. The process for assembling a drive pipe as claimed in claim 1, wherein said transporting comprises towing the drive pipe through the ocean, wherein the drive pipe is submerged in the ocean in an approximately neutrally buoyant condition during said towing.

4. The process for assembling a drive pipe as claimed in claim 1, wherein said deploying comprises attaching an upper end of the drive pipe to a drill string and lowering the drive pipe to the ocean floor with the drill string.

5. The process for assembling a drive pipe as claimed in claim 1, further comprising assembling a drive mechanism to the drive pipe.

6. A process for assembling a drive pipe for us at an offshore drill site, said process comprising:

assembling the drive pipe at a shoreline assembly station;

floating the drive pipe in the ocean;

transporting the floating drive pipe from the shoreline assembly station to the offshore drill site;

suspending the floating drive pipe from a drilling vessel at the offshore drill site;

deploying the drive pipe to the ocean floor;

wherein said suspending comprises coupling an upper end of the drive pipe to the drilling vessel and sinking the drive pipe in the ocean, whereby a substantial portion of the weight of the drive pipe is supported by the drilling vessel; and wherein said sinking comprises deactivating a buoyancy function of at least one floatation device attached to the drive pipe.

7. A process for assembling a drive pipe for use at an offshore drill site, said process comprising:

assembling the drive pipe at a shoreline assembly station;

floating the drive pipe in the ocean;

transporting the floating drive pipe from the shoreline assembly station to the offshore drill site;

suspending the floating drive pipe from a drilling vessel at the offshore drill site;

deploying the drive pipe to the ocean floor;

wherein said suspending comprises coupling an upper end of the drive pipe to the drilling vessel and sinking the drive pipe in the ocean, whereby a substantial portion of the weight of the drive pipe is supported by the drilling vessel; and wherein said sinking comprises breaching an interior cavity of said drive pipe, wherein the interior cavity is initially a gas filled chamber, and whereby ocean water is allowed to enter the interior cavity.

8. A process for assembling a drive pipe for use at an offshore drill site, said process comprising:

assembling the drive pipe at a shoreline assembly station, wherein said assembling comprises fitting pipe sections end to end;

floating the drive pipe in the ocean;

transporting the floating drive pipe from the shoreline assembly station to the offshore drill site, wherein said transporting comprises towing the drive pipe through the ocean, wherein the drive pipe is submerged in the ocean in an approximately neutrally buoyant condition during said towing;

suspending the floating drive pipe from a drilling vessel at the offshore drill site, wherein said suspending comprises coupling an upper end of the drive pipe to the drilling vessel and sinking the drive pipe in the ocean, whereby a substantial portion of the weight of the drive pipe is supported by the drilling vessel;

deploying the drive pipe to the ocean floor, wherein said deploying comprises attaching the upper end of the drive pipe to a drill string and lowering the drive pipe to the ocean floor with the drill string;

wherein said floating comprises attaching at least one floatation device to the drive pipe and adjusting the buoyancy of the at least one floatation device until the drive pipe is approximately neutrally buoyant, and wherein said sinking comprises deactivating a buoyancy function of the at least one floatation device attached to the drive pipe.

9. The process for assembling a drive pipe as claimed in claim 8, further comprising assembling a drive mechanism to the drive pipe.

10. A process for assembling a drive pipe for use at an offshore drill site, said process comprising:

assembling the drive pipe at a shoreline assembly station, wherein said assembling comprises fitting pipe sections end to end;

floating the drive pipe in the ocean;

transporting the floating drive pipe from the shoreline assembly station to the offshore drill site, wherein said transporting comprises towing the drive pipe through the ocean, wherein the drive pipe is submerged in the ocean in an approximately neutrally buoyant condition during said towing;

suspending the floating drive pipe from a drilling vessel at the offshore drill site, wherein said suspending comprises coupling an upper end of the drive pipe to the drilling vessel and sinking the drive pipe in the ocean, whereby a substantial portion of the weight of the drive pipe is supported by the drilling vessel;

deploying the drive pipe to the ocean floor, wherein said deploying comprises attaching the upper end of the drive pipe to a drill string and lowering the drive pipe to the ocean floor with the drill string;

wherein said floating comprises sealing an interior cavity of said drive pipe, whereby a gas filled chamber is created within said drive pipe which buoys the drive pipe, and wherein said sinking comprises breaching the interior cavity of said drive pipe, wherein the interior cavity is initially the gas filled chamber, and whereby ocean water is allowed to enter the interior cavity.

11. A process for reducing the amount of time required for a drill vessel to assemble and deploy a drive pipe at an offshore drill site, said process comprising:

delivering an assembled drive pipe to the drill vessel at the offshore drill site;

suspending the drive pipe from the drill vessel; and deploying the drive pipe to the ocean floor; and wherein said deploying comprises attaching an upper end of the drive pipe to a drill string and lowering the drive pipe to the ocean floor with the drill string.

12. The process as claimed in claim 11, wherein said suspending comprises coupling an upper end of the drive pipe to the drilling vessel and sinking the drive pipe in the ocean, whereby a substantial portion of the weight of the drive pipe is supported by the drilling vessel.

13. The process as claimed in claim 11, further comprising assembling a drive mechanism to the drive pipe.

* * * * *